US010784060B2

(12) United States Patent
Wu

(10) Patent No.: US 10,784,060 B2
(45) Date of Patent: Sep. 22, 2020

(54) DUAL-POWER OVERLAPPING CONTACT CLOSING MECHANISM

(71) Applicant: Garbsen Electric (Shanghai) Co., Ltd, Shanghai (CN)

(72) Inventor: Rui Wu, Shanghai (CN)

(73) Assignee: Garbsen Electric (Shanghai) Co., Ltd, Shanghai (CN)

( * ) Notice: Subject to any disclaimer, the term of this patent is extended or adjusted under 35 U.S.C. 154(b) by 0 days.

(21) Appl. No.: 16/421,564

(22) Filed: May 24, 2019

(65) Prior Publication Data

US 2019/0371540 A1 Dec. 5, 2019

(30) Foreign Application Priority Data

May 29, 2018 (CN) ..... 201810532840.0

(51) Int. Cl.

| | |
|---|---|
| ***H01H 9/26*** | (2006.01) |
| ***H01H 3/46*** | (2006.01) |
| ***H01H 9/00*** | (2006.01) |
| ***H01H 3/40*** | (2006.01) |

(52) U.S. Cl.

CPC ..... *H01H 9/26* (2013.01); *H01H 3/40* (2013.01); *H01H 3/46* (2013.01); *H01H 9/0072* (2013.01)

(58) Field of Classification Search

CPC .. H01H 3/32; H01H 3/42; H01H 3/46; H01H 9/26; H01H 2009/0088; H01H 2300/018

See application file for complete search history.

(56) References Cited

U.S. PATENT DOCUMENTS

| | | | | |
|---|---|---|---|---|
| 4,736,114 A * | 4/1988 | Reichl | H02B 1/24 | 200/11 TC |
| 5,070,252 A * | 12/1991 | Castenschiold | H01H 71/002 | 307/113 |
| 6,815,624 B2 * | 11/2004 | Schultz | H01H 9/0066 | 200/50.33 |

* cited by examiner

*Primary Examiner* — Vanessa Girardi

(57) ABSTRACT

The present invention discloses a dual-power overlapped closing operation mechanism, relating to the field of dual-power switches. The dual-power overlapped closing operation mechanism comprises a first contact, a second contact, a first connecting rod, a second connecting rod, a third connecting rod, a fourth connecting rod, a fifth connecting rod, a sixth connecting rod, a seventh connecting rod, a first auxiliary shaft, a second auxiliary shaft and a third auxiliary shaft. The fourth connecting rod rotates anticlockwise to push, via the fifth connecting rod and the seventh connecting rod, the second contact to make electrical contact with the second fixed contact, and at the same time the first contact is first tightly pressed via the second connecting rod and the third connecting rod until the dead point is passed, and then the first contact is gradually opened clockwise. The result of the fourth connecting rod rotating clockwise is similar, in which the second contact is first tightly pressed until the dead point is passed, and then the second contact is gradually opened clockwise. With the present invention, the neutral line overlapping has an extended duration and is maintained by means of a mechanical structure so as to effectively avoid the occurrence of a zero line break.

10 Claims, 3 Drawing Sheets

DUAL-POWER OVERLAPPING CONTACT CLOSING MECHANISM

TECHNICAL FIELD

The present invention relates to the field of dual-power switches, and in particular to a dual-power overlapped closing operation mechanism.

BACKGROUND ART

When a traditional dual-power switch is switched from a normal power supply state to a standby power supply state, a load N-phase connection terminal has a transient vacated phenomenon. In practical applications, a neutral line drift voltage generated as a result of a zero line break is up to dozens or even hundreds of volts, which is possible to cause damage to electric devices, for example, to directly cause the server to restart or burn out, and thus there are significant security risks.

A dual-power switch with a neutral line overlapped switching function is disclosed in the patent 201010105826.6. A normal N-phase movable contact assembly of the dual-power switch comprises a normal driving part and a connecting part, which are respectively fixedly and rotatably mounted on a normal driving square shaft; a standby N-phase movable contact assembly comprises a standby driving part and a connecting part, which are respectively fixedly and rotatably mounted on a standby driving square shaft; the normal driving part is used to cooperate with the standby connecting part to drive a movable contact of the standby N-phase movable contact assembly to be in electrical contact with a N-phase fixed contact or to break the electrical contact with the N-phase fixed contact; and the standby driving part is used to cooperate with the normal connecting part to drive a movable contact of the normal N-phase movable contact assembly to break the electrical contact with the N-phase fixed contact or to be in electrical contact with the N-phase fixed contact. In the present invention, the neutral line "vacated" phenomenon can be avoided during the switching of the dual-power switch, which effectively protects electric devices. But in existing structures, a contact connecting rod doesn't pass the dead point, which is achieved only by delay action of the connecting rod, so that the neutral line overlapping has a short duration, and the contacts are easy to malfunction, so it is still possible to lead to a zero line break, and thus there are still significant security risks.

Therefore, those skilled in the art are devoted to develop a new dual-power overlapped closing operation mechanism, with which the neutral line overlapping has an extended duration and is maintained by means of a mechanical structure all the time during movement of the mechanism, so as to achieve a stable and reliable action of the closing operation.

SUMMARY OF THE INVENTION

In view of the above defects of the prior art, the technical problem to be solved by the present invention is how to avoid the occurrence of zero line break to effectively protect the security of electric devices.

In order to realize the above purpose, the present invention provides a dual-power overlapped closing operation mechanism, comprising a first contact, a second contact, a first connecting rod, a second connecting rod, a third connecting rod, a fourth connecting rod, a fifth connecting rod, a sixth connecting rod, a seventh connecting rod, a first fixed contact, a second fixed contact, a first auxiliary shaft, a second auxiliary shaft and a third auxiliary shaft; wherein the first auxiliary shaft, the second auxiliary shaft and the third auxiliary shaft are arranged in parallel, and the second auxiliary shaft is located between the first auxiliary shaft and the third auxiliary shaft; the first contact is located on one side of the first auxiliary shaft, and the second contact is located on one side of the third auxiliary shaft; the first contact is connected to the first auxiliary shaft via the first connecting rod and the second connecting rod, the second contact is connected to the third auxiliary shaft via the sixth connecting rod and the seventh connecting rod, and the fourth connecting rod is fixedly connected to the second auxiliary shaft; one end of the third connecting rod is connected to the fourth connecting rod, and the other end thereof is connected to a joint between the first connecting rod and the second connecting rod; one end of the fifth connecting rod is connected to a joint between the third connecting rod and the fourth connecting rod, and the other end thereof is connected to a joint between the sixth connecting rod and the seventh connecting rod; the first contact is in electrical contact with the first fixed contact when the first contact is closed, and the first contact breaks the electrical contact with the first fixed contact when the first contact is opened; the second contact is in electrical contact with the second fixed contact when the second contact is closed, and the second contact breaks the electrical contact with the second fixed contact when the second contact is opened;

the fourth connecting rod follows the second auxiliary shaft to rotate clockwise or anticlockwise; the fourth connecting rod rotates anticlockwise to push, via the fifth connecting rod and the seventh connecting rod, the second contact to make electrical contact with the second fixed contact, and at the same time the first contact is first further tightly pressed via the first connecting rod and the third connecting rod until the dead point is passed, and then the first contact is gradually opened clockwise; during the process from opening to closing the second contact and the second fixed contact, the first contact and the first fixed contact are in a closed state all the time until the second contact and the second fixed contact have been in the closed state for a period of time, and then the first contact is gradually opened; the fourth connecting rod rotates clockwise to push, via the third connecting rod and the first connecting rod, the first contact to make electrical contact with the first fixed contact, and at the same time the second contact is first further tightly pressed via the fifth connecting rod and the seventh connecting rod until the dead point is passed, and then the second contact is gradually opened clockwise; and during the process from opening to closing the first contact and the first fixed contact, the second contact and the second fixed contact are in a closed state all the time until the first contact and the first fixed contact have been in the closed state for a period of time, and then the second contact is gradually opened.

Further, the mechanism further comprises a first main shaft and a second main shaft arranged in parallel to each other, wherein one side of the first main shaft is fixedly connected to a third gear, and an extension line of the other side of the first main shaft is provided with the third auxiliary shaft; one side of the second main shaft is fixedly connected to a first gear, and an extension line of the other side of the second main shaft is provided with the first auxiliary shaft; a second gear is located between the first gear and the third gear; the first gear, the second gear and the third gear mesh with each other; and the second auxiliary shaft passes through the center of the second gear and is fixedly connected to the second gear.

Further, a group of A, B and C three-phase contacts are connected on the first main shaft via a connecting rod system; and a further group of A, B and C three-phase contacts are connected on the second main shaft via a connecting rod system.

Further, the first main shaft rotates anticlockwise, and the group of A, B and C three-phase contacts on the first main shaft follow the first main shaft to switch from a closed state to an open state; and the first main shaft rotates clockwise, and the A, B and C three-phase contacts switch from the open state to the closed state.

Further, the second main shaft rotates anticlockwise, and the A, B and C three-phase contacts switch from the open state to the closed state; and the second main shaft rotates clockwise, and the A, B and C three-phase contacts switch from the closed state to the open state.

Further, both the first contact and the second contact are N-phase contacts.

Further, the first gear, the second gear and the third gear are of the same size.

Further, the first gear and the third gear are located on a same side of the first main shaft and the second main shaft.

Further, the connection at a joint of the first connecting rod, the second connecting rod and the third connecting rod is in a hinged manner, the connection at a joint of the third connecting rod, the fourth connecting rod and the fifth connecting rod is in a hinged manner, and the connection at a joint of the fifth connecting rod, the sixth connecting rod and the seventh connecting rod is in a hinged manner.

Further, the mechanism further comprises a fixing seat on which the operation mechanism is fixed.

With the dual-power overlapped closing operation mechanism provided in the present invention, the neutral line overlapping has an extended duration and is maintained by means of a mechanical structure all the time during the switching of power sources, so as to achieve stable and reliable actions, thereby significantly effectively avoiding the occurrence of a zero line break so as to stably protect electric devices.

The concept, the specific structure and the technical effects of the present invention will be further described in conjunction with the accompanying drawings in order to fully understand the objects, features and effects of the present invention.

Figure 1:
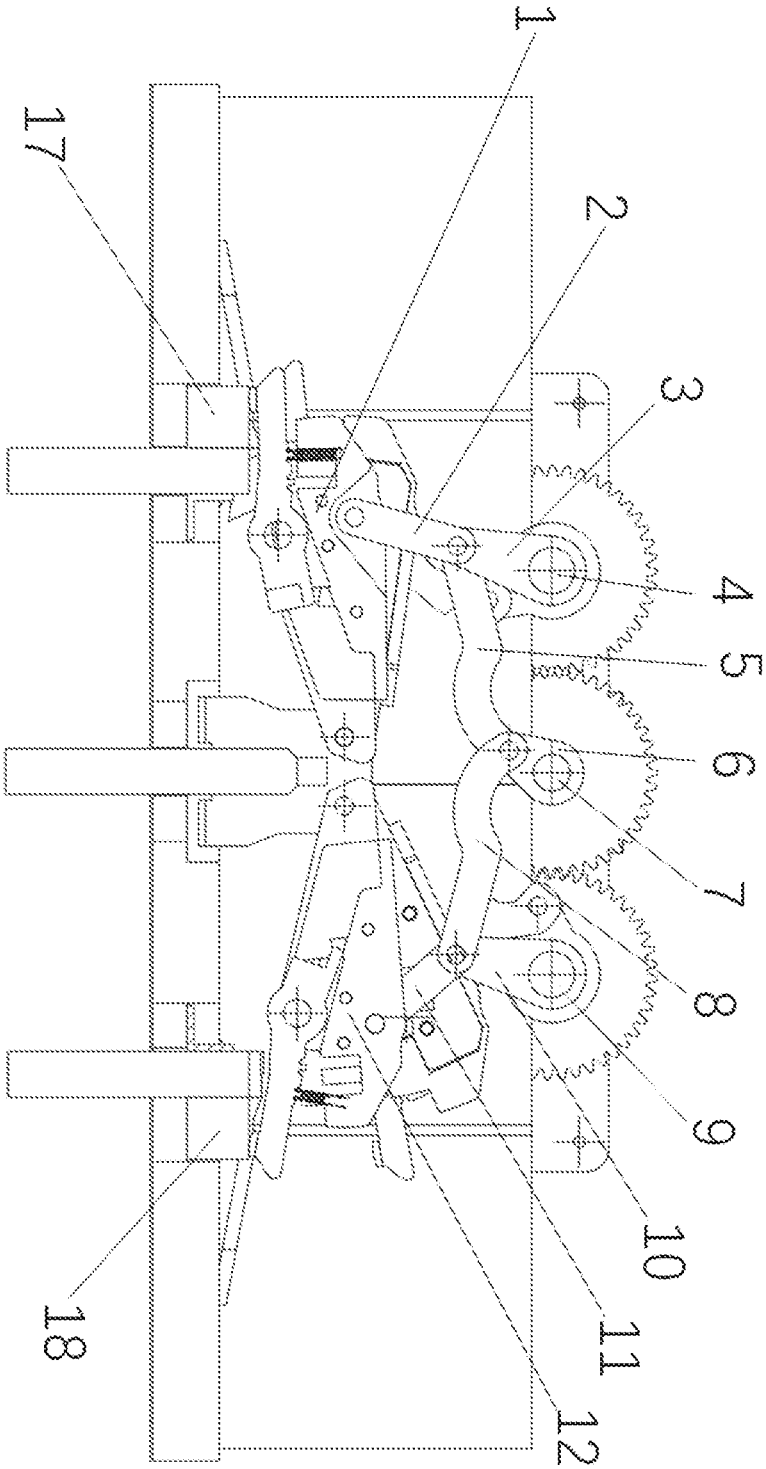
FIG. 1 is a side structural schematic diagram of a preferred embodiment of the present invention.

In the figures, 1—first contact, 2—first connecting rod, 3—second connecting rod, 4—first auxiliary shaft, 5—third connecting rod, 6—fourth connecting rod, 7—second auxiliary shaft, 8—fifth connecting rod, 9—third auxiliary shaft, 10—sixth connecting rod, 11—seventh connecting rod, 12—second contact, 13—fixing seat, 14—first gear, 15—second gear, 16—third gear, 17—first fixed contact, 18—second fixed contact, 19—first main shaft, and 20—second main shaft.

DETAILED DESCRIPTION OF EMBODIMENTS

Preferred embodiments of the present invention are described below with reference to the drawings of the description to make the technical contents clearer and easier to understand. The present invention can be embodied in various forms of embodiments, and the scope of protection of the present invention is not limited to the embodiments mentioned herein.

In the figures, the same reference numeral indicates components having the same structure, and similar reference numerals indicate assemblies having similar structures or functions throughout. The size and thickness of each assembly shown in the figures are shown arbitrarily, and the present invention does not define the size and thickness of each assembly. In order to make the illustration clearer, the thickness of the component in some places of the figures is appropriately exaggerated.

Figure 3:
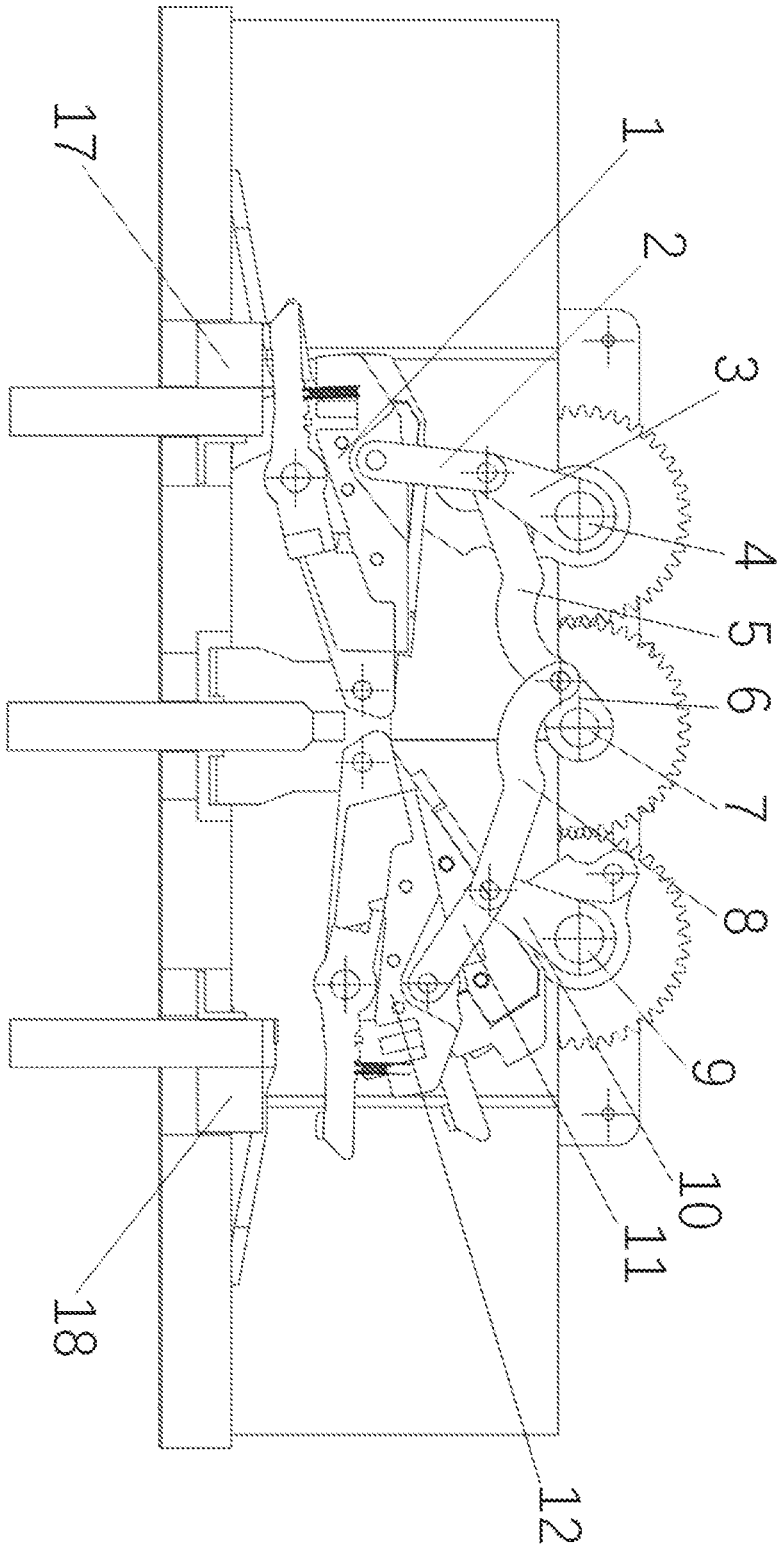
FIG. 3 is a side structural schematic diagram of a preferred embodiment of the present invention.

As shown in FIG. 1, the dual-power overlapped closing operation mechanism of the present invention comprises a first contact 1, a first connecting rod 2, a second connecting rod 3, a first auxiliary shaft 4, a third connecting rod 5, a fourth connecting rod 6, a second auxiliary shaft 7, a fifth connecting rod 8, a third auxiliary shaft 9, a sixth connecting rod 10, a seventh connecting rod 11, a second contact 12, a first fixed contact 17 and a second fixed contact 18. the first auxiliary shaft 4, the second auxiliary shaft 7 and the third auxiliary shaft 9 are connected to the first contact 1 and the second contact 12 via a plurality connecting rod connect. Specifically, the first contact 1 is connected to the first auxiliary shaft 4 via the first connecting rod 2 and the second connecting rod 3; the second contact 12 is connected to the third auxiliary shaft 9 via the sixth connecting rod 10 and the seventh connecting rod 11; the fourth connecting rod 6 is fixedly connected to the second auxiliary shaft 7; one end of the third connecting rod 5 is connected to the fourth connecting rod 6, and the other end thereof is connected to a joint between the first connecting rod 2 and the second connecting rod 3; one end of the fifth connecting rod 8 is connected to a joint between the third connecting rod 5 and the fourth connecting rod 6, and the other end thereof is connected to a joint between the sixth connecting rod 10 and the seventh connecting rod 11; the first contact 1 makes electrical contact with the first fixed contact 17 when the first contact 1 is closed, and the first contact 1 breaks the electrical contact with the first fixed contact 17 when the first contact 1 is opened; the second contact 12 makes electrical contact with the second fixed contact 18 when the second contact 12 is closed, and the second contact 12 breaks the electrical contact with the second fixed contact 18 when the second contact 12 is opened; and the second auxiliary shaft 7 rotating clockwise or anticlockwise will drive the first contact 1 and second contact 12 to open and close, and in the opening and closing process of the first contact 1 and the second contact 12, it is ensured that after the contact and the corresponding fixed contact on one side have been in a closed state for a period of time, the contacts on the other side are gradually opened, so as to ensure that there is a neutral line overlapping time during the closing operation. The specific implementation process is as follows. The second auxiliary shaft 7 rotates clockwise, meanwhile the second contact 12 is in electrical contact state with the second fixed contact 18, and the first contact 1 is in an open state. Since the fourth connecting rod 6 is fixedly connected to the second auxiliary shaft 7, the fourth connecting rod 6 also rotates clockwise. The fourth connecting rod 6 rotating clockwise will push the third connecting rod 5 and act on the joint between the first connecting rod 2 and the second connecting rod 3 to drive the first auxiliary shaft 4 to rotate anticlockwise, and the second connecting rod 3 rotating anticlockwise will push the first contact 1 from the open state to the closed state via the first connecting rod 2. At the same time, the fourth connecting rod 6 rotating clockwise will also drive, via the fifth connecting rod 8 and the sixth connecting rod 10, the third auxiliary shaft 9 to rotate clockwise, and the sixth connecting rod 10 rotating clockwise first further tightly presses the second contact 12 via the seventh connecting rod 11 until the dead point is passed. After the dead point is passed, the second contact 12 rotates anticlockwise again to gradually break the electrical contact between the second contact 12 and the second fixed contact 18 (as shown in FIG. 3). When the second auxiliary shaft 7 rotates anticlockwise, the first contact 1 is in an electrical contact state with the first fixed contact 17, and the second contact 12 is in the open state. Since the fourth connecting rod 6 is fixedly connected to the second auxiliary shaft 7, the fourth connecting rod 6 also rotates anticlockwise. The fourth connecting rod 6 rotating anticlockwise will push the fifth connecting rod 8 and act on a joint between the sixth connecting rod 10 and the seventh connecting rod 11 to drive the third auxiliary shaft 9 to rotate anticlockwise, and the sixth connecting rod 10 rotating anticlockwise will push the first contact 2 from the open state to the closed state via the seventh connecting rod 11. At the same time, the fourth connecting rod 6 rotating anticlockwise will also drive, via the third connecting rod 5 and the second connecting rod 3, the first auxiliary shaft 4 to rotate anticlockwise, and the second connecting rod 3 rotating anticlockwise first further tightly press the first contact 1 via the first connecting rod 2 until the dead point is passed. After the dead point is passed, the first contact 1 rotates clockwise to gradually break the electrical contact between the first contact 1 and the first fixed contact 17. The first auxiliary shaft 4, the second auxiliary shaft 7 and the third auxiliary shaft 9 are arranged in parallel, the second auxiliary shaft 7 is located between the first auxiliary shaft 4 and the third auxiliary shaft 9, the first contact 1 is located on one side of the first auxiliary shaft, and the second contact is located on one side of the third auxiliary shaft. Both the first contact 1 and the second contact 12 are N-phase contacts. The connection at a joint of the first connecting rod 2, the second connecting rod 3 and the third connecting rod 5 is in a hinged manner, the connection at a joint of the third connecting rod 5, the fourth connecting rod 6 and the fifth connecting rod 8 is in a hinged manner, the connection at a joint of the fifth connecting rod 8, the sixth connecting rod 10 and the seventh connecting rod 11 is in a hinged manner.

Figure 2:
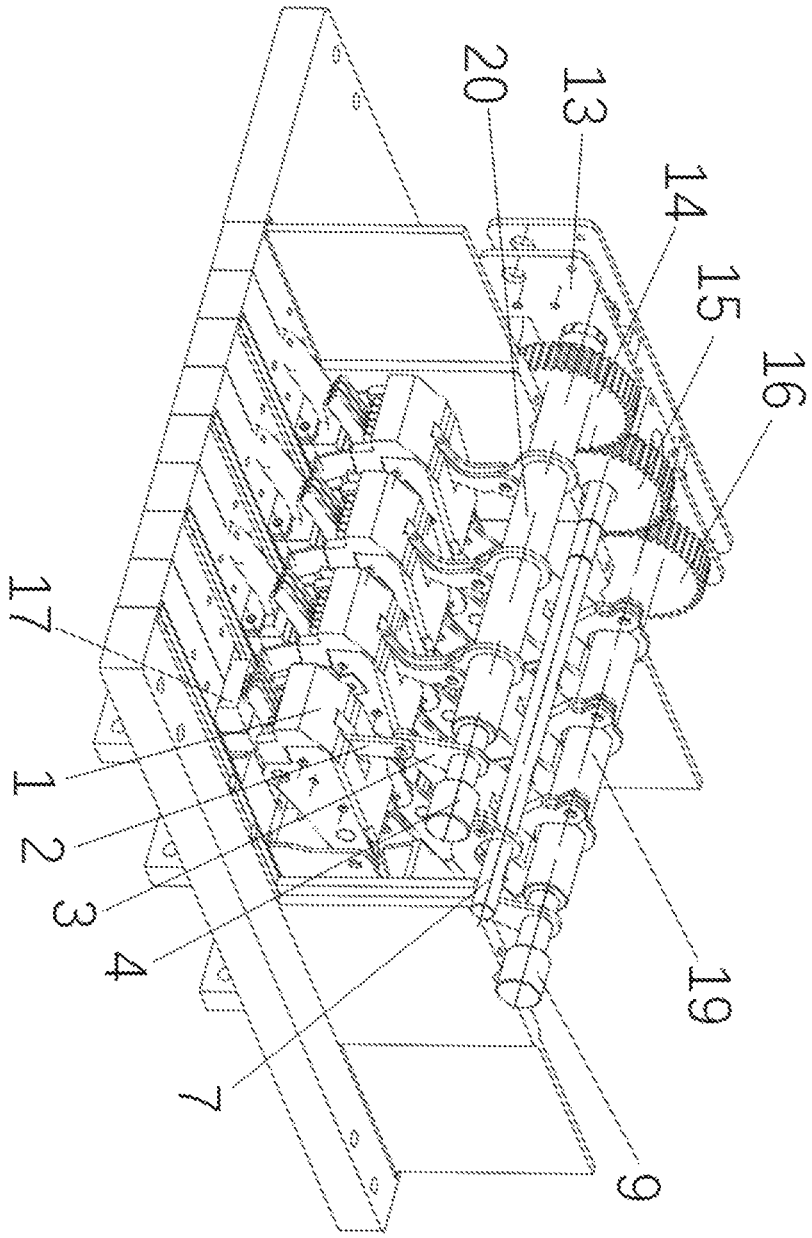
FIG. 2 is a three-dimensional structural schematic diagram of a preferred embodiment of the present invention.

As shown in FIG. 2, the dual-power overlapped closing operation mechanism of the present invention further comprises a first main shaft 19 and a second main shaft 20 arranged in parallel to each other, wherein one side of the first main shaft 19 is fixedly connected to a third gear 16, and an extension line of the other side of the first main shaft 19 is provided with the third auxiliary shaft 9; one side of the second main shaft 20 is fixedly connected to a first gear 14, and an extension line of the other side of the second main shaft 20 is provided with the first auxiliary shaft 4; a second gear 15 is located between the first gear 14 and the third gear 16; the first gear 14, the second gear 15 and the third gear 16 mesh with each other; and the first gear 14, the second gear 15 and the third gear 16 are of the same size. The first gear 14 and the third gear 16 are located on a same side of the first main shaft 19 and the second main shaft 20. The second auxiliary shaft 7 passes through the center of the second gear 15 and is fixedly connected to the second gear 15. A group of A, B and C three-phase contacts are connected on the first main shaft 19 via a connecting rod system, and a further group of A, B and C three-phase contacts are connected to the second main shaft 20 via a connecting rod system. The group of A, B and C three-phase contacts on the first main shaft 19 follow the anticlockwise rotation of the first main shaft 19 to switch from the closed state to the open state; and the first main shaft 19 rotates clockwise, and the A, B and C three-phase contacts switch from the open state to the closed state. The second main shaft 20 rotates anticlockwise, and the A, B and C three-phase switch moves from the open state to the closed state; and the second main shaft 20 rotates clockwise, and the A, B and C three-phase contacts switch from the closed state to the open state. The dual-power overlapped closing operation mechanism of the present invention further comprises a fixing seat on which the entire operation mechanism is fixed.

The specific preferred embodiment of the present invention is described in detail as above. It should be appreciated that a person of ordinary skill in the art would be able to make modifications and variations in accordance with the concept of the present invention without involving any inventive effort. Therefore, any technical solution that can be obtained by a person skilled in the art based on the prior art by means of logic analysis, reasoning or limited trials should be within the scope of protection determined by the claims.

The invention claimed is:

1. A dual-power overlapped closing operation mechanism, characterized by comprising a first contact, a second contact, a first connecting rod, a second connecting rod, a third connecting rod, a fourth connecting rod, a fifth connecting rod, a sixth connecting rod, a seventh connecting rod, a first fixed contact, a second fixed contact, a first auxiliary shaft, a second auxiliary shaft and a third auxiliary shaft; wherein the first auxiliary shaft, the second auxiliary shaft and the third auxiliary shaft are arranged in parallel, and the second auxiliary shaft is located between the first auxiliary shaft and the third auxiliary shaft; the first contact is located on one side of the first auxiliary shaft, and the second contact is located on one side of the third auxiliary shaft; the first contact is connected to the first auxiliary shaft via the first connecting rod and the second connecting rod, the second contact is connected to the third auxiliary shaft via the sixth connecting rod and the seventh connecting rod, and the fourth connecting rod is fixedly connected to the second auxiliary shaft; one end of the third connecting rod is connected to the fourth connecting rod, and the other end thereof is connected to a joint between the first connecting rod and the second connecting rod; one end of the fifth connecting rod is connected to a joint between the third connecting rod and the fourth connecting rod, and the other end thereof is connected to a joint between the sixth connecting rod and the seventh connecting rod; the first contact is in electrical contact with the first fixed contact when the first contact is closed, and the first contact breaks the electrical contact with the first fixed contact when the first contact is opened; the second contact is in electrical contact with the second fixed contact when the second contact is closed, and the second contact breaks the electrical contact with the second fixed contact when the second contact is opened;

the fourth connecting rod follows the second auxiliary shaft to rotate clockwise or anticlockwise; the fourth connecting rod rotates anticlockwise to push, via the fifth connecting rod and the seventh connecting rod, the second contact to make electrical contact with the second fixed contact, and at the same time the first contact is first further tightly pressed via the first connecting rod and the third connecting rod until a dead point is passed, and then the first contact is opened clockwise; during a process from opening to closing the second contact and the second fixed contact, the first contact and the first fixed contact are in a closed state all the time, and after the second contact and the second fixed contact are the closed state the first contact is opened; the fourth connecting rod rotates clockwise to push, via the third connecting rod and the first connecting rod, the first contact to make electrical contact with the first fixed contact, and at the same time the second contact is first further tightly pressed via the fifth connecting rod and the seventh connecting rod until a dead point is passed, and then the second contact is opened clockwise; and during a process from opening to closing the first contact and the first fixed contact, the second contact and the second fixed contact are in a closed state all the time, and after the first contact and the first fixed contact are in the closed state, the second contact is opened.

2. The dual-power overlapped closing operation mechanism of claim 1, characterized in that both the first contact and the second contact are N-phase contacts.

3. The dual-power overlapped closing operation mechanism of claim 1, characterized in that a connection at a joint of the first connecting rod, the second connecting rod and the third connecting rod is in a hinged manner, a connection at a joint of the third connecting rod, the fourth connecting rod and the fifth connecting rod is in a hinged manner, and a connection at a joint of the fifth connecting rod, the sixth connecting rod and the seventh connecting rod is in a hinged manner.

4. The dual-power overlapped closing operation mechanism of claim 1, characterized by further comprising a first main shaft and a second main shaft arranged in parallel to each other, wherein one side of the first main shaft is fixedly connected to a third gear, and an extension line of the other side of the first main shaft is provided with the third auxiliary shaft; one side of the second main shaft is fixedly connected to a first gear, and an extension line of the other side of the second main shaft is provided with the first auxiliary shaft; a second gear is located between the first gear and the third gear; the first gear, the second gear and the third gear mesh with each other; and the second auxiliary shaft passes through the center of the second gear and is fixedly connected to the second gear.

5. The dual-power overlapped closing operation mechanism of claim 4, characterized in that the first gear, the second gear and the third gear are of the same size.

6. The dual-power overlapped closing operation mechanism of claim 4, characterized in that the first gear and the third gear are located on a same side of the first main shaft and the second main shaft.

7. The dual-power overlapped closing operation mechanism of claim 4, characterized by further comprising a fixing seat on which the operation mechanism is fixed.

8. The dual-power overlapped closing operation mechanism of claim 4, characterized in that a group of A, B and C three-phase contacts are connected on the first main shaft via a connecting rod system; and a further group of A, B and C three-phase contacts are connected on the second main shaft via a connecting rod system.

9. The dual-power overlapped closing operation mechanism of claim characterized in that the first main shaft rotates anticlockwise, and the group of A, B and C three-phase contacts on the first main shaft follow the first main shaft to switch from a closed state to an open state; and the first main shaft rotates clockwise, and the A, B and C three-phase contacts switch from the open state to the closed state.

10. The dual-power overlapped closing operation mechanism of claim 8, characterized in that the second main shaft rotates anticlockwise, and the A, B and C three-phase contacts switch from the open state to the closed state; and the second main shaft rotates clockwise, and the A, B and C three-phase contacts switch from the closed state to the open state.

* * * * *